US005291821A

United States Patent [19]

Yamashita et al.

[11] Patent Number: 5,291,821

[45] Date of Patent: Mar. 8, 1994

[54] HYDRAULIC CIRCUIT FOR SWIVEL WORKING MACHINE

[75] Inventors: Kohji Yamashita, Yokahama; Teruo Akiyama, Fujisawa; Tadao Karakama, Musashino; Naoki Isizaki, Kamakura, all of Japan

[73] Assignee: Kabushiki Kaisha Komatsu Seisakusho, Tokyo, Japan

[21] Appl. No.: 969,161

[22] PCT Filed: Jun. 10, 1992

[86] PCT No.: PCT/JP92/00742

§ 371 Date: Feb. 11, 1993

§ 102(e) Date: Feb. 11, 1993

[87] PCT Pub. No.: WO92/22712

PCT Pub. Date: Dec. 23, 1992

[30] Foreign Application Priority Data

Jun. 12, 1991 [JP] Japan ..... 3-166230

[51] Int. Cl.[5] ..... F15B 11/16

[52] U.S. Cl. ..... 91/447; 91/468; 60/426

[58] Field of Search ..... 60/422, 426, 427, 450, 60/451, 452; 91/446, 447, 468, 513, 514, 532

[56] References Cited

U.S. PATENT DOCUMENTS 4,938,023 7/1990 Yoshino ..... 60/452
5,209,063 5/1993 Shirai et al. ..... 91/426

FOREIGN PATENT DOCUMENTS 2906670 9/1980 Fed. Rep. of Germany ..... 91/447
59-34336 2/1984 Japan .
59-161524 9/1984 Japan .
61-173561 10/1986 Japan .
62-288702 12/1987 Japan .
64-87901 4/1989 Japan .
2-49405 10/1990 Japan .
2-286902 11/1990 Japan .
3-115625 5/1991 Japan .

*Primary Examiner*—Edward K. Look
*Assistant Examiner*—F. Daniel Lopez
*Attorney, Agent, or Firm*—Richards, Medlock & Andrews

[57] ABSTRACT

A hydraulic circuit for a swivel working machine, in which the operation of the working unit is speeded up when the swiveling body and the working unit are simultaneously operated, includes, for this purpose, first and second operating valves (15$_1$ and 15$_2$) connecting the delivery conduit of a hydraulic pump (10) to a swiveling hydraulic motor (16$_1$) and to a working unit cylinder (16$_2$), and pressure compensating valves (18) provided between the first operating valve (15$_1$) and the swiveling hydraulic motor (16$_1$) and between the second operating valve (15$_2$) and the working unit cylinder (16$_2$), the load pressure of the swiveling hydraulic motor (16$_1$) and the load pressure of the working unit cylinder (16$_2$) being introduced into a load pressure introducing conduit (23) by way of check valves (42), the pressure compensating valves (18) being set by the load pressure of the load pressure introducing conduit (23), the check valve (42) for detecting the load pressure of the swiveling hydraulic motor (16$_1$) being prevented from operating when the second operating valve (15$_2$) is operated.

24 Claims, 3 Drawing Sheets

HYDRAULIC CIRCUIT FOR SWIVEL WORKING MACHINE

TECHNICAL FIELD

This invention relates to a hydraulic circuit for supplying delivery pressure oil from a hydraulic pump to a swiveling hydraulic motor and a working unit cylinder in a swivel working machine, such as a hydraulic excavator, which has a working unit attached to a swiveling body.

BACKGROUND ART

To supply delivery pressure oil from a hydraulic pump to a plurality of hydraulic actuators, a plurality of operating valves are provided in the delivery conduit of the hydraulic pump, pressure oil being supplied to the hydraulic actuators by switching these operating valves. A problem with this arrangement is that when supplying pressure oil simultaneously to the plurality of hydraulic actuators, the supply of pressure oil reaches only to those hydraulic actuators having small loads, with no pressure oil being supplied to those hydraulic actuators having large loads.

An example of a hydraulic circuit designed to be a solution of the above problem is disclosed in Japanese Patent Publication No. 2-49405.

FIG. 1 schematically shows such a hydraulic circuit. The hydraulic circuit shown includes operating valves 2 provided in a delivery conduit 1*a* of a hydraulic pump 1 and pressure compensating valves 5 provided in circuits 4 connecting the operating valves 2 to hydraulic actuators 3. Check valves 6 detect the maximum of the load pressures. The detected load pressure is caused to act on the pressure compensating valves 5 so as to set them to a pressure level counterbalancing this load pressure, thereby equalizing the pressures on the output sides of the operating valves 2. Thus, when the operating valves 2 are simultaneously operated, pressure oil can be supplied to the hydraulic actuators 3 in a flow dividing ratio proportional to the respective opening areas of the operating valves 2.

With such a hydraulic circuit, the pressure compensating valves 5 function so as to enable a flow division proportional to the respective opening areas of the operating valves 2 regardless of the magnitudes of the loads of the hydraulic actuators 3, so that it is possible for the hydraulic actuators 3 to be supplied with delivery pressure oil from a single hydraulic pump 1 in a flow dividing ratio proportional to the respective operation amounts of the operating valves 2.

However, due to the setting of the pressure compensating valves 5 to a pressure level counterbalancing the maximum load pressure, the opening (aperture) of the pressure compensating valve 5 having a relatively high load pressure is large, whereas the opening (aperture) of the pressure compensating valve 5 having a relatively low load pressure is small. Thus, when the difference in load pressure is excessively large, the opening of the pressure compensating valve 5 having a relatively low load pressure becomes extremely small, with the result that practically no pressure oil is supplied to the hydraulic actuator 3 under the lower load pressure. When applied to a swivel working machine, this hydraulic circuit involves the following problem: the swiveling body has a large inertial force, so that when the swiveling body and the working unit are simultaneously operated, the swiveling body has, in the early stage of swiveling, a load pressure which is substantially higher than that of the working unit cylinder, resulting in practically no pressure oil being supplied to the working unit cylinder. When the swiveling body starts to swivel at a steady speed, the load pressure of the swiveling hydraulic motor is lowered, with the result that a large amount of pressure oil is supplied to the working unit cylinder.

Thus, when the swiveling body and the working unit are simultaneously operated, the working unit performs practically no operation in the early stage of swiveling. The working unit starts to operate only when the swiveling body has started to operate at a steady speed.

DISCLOSURE OF THE INVENTION

It is an object of this invention to provide a hydraulic circuit for a swivel working machine which helps eliminate such an operational delay as mentioned above in the working unit.

In accordance with the present invention, there is provided a hydraulic circuit for a swivel working machine of the type in which a delivery conduit of a hydraulic pump is connected to a swiveling hydraulic motor and a working unit cylinder by way of first and second operating valves, respectively, and in which pressure compensating valves are provided between the first operating valve and the swiveling hydraulic motor and between the second operating valve and the working unit cylinder, the respective load pressures of the swiveling hydraulic motor and the working unit cylinder being introduced into a load pressure introducing conduit by way of check valves to set the pressure compensating valves by the load pressure of the load pressure introducing conduit, wherein the check valve for detecting the load pressure of the swiveling hydraulic motor is prevented from operating when the working unit cylinder is operated by the second operating valve. Thus, when the swiveling hydraulic motor and the working unit cylinder are simultaneously operated, the load pressure of the working unit cylinder is detected in the load pressure introducing conduit, and the pressure compensating valves are set with that load pressure, thereby making it possible to effect enlargement of the opening and sufficiently supply the working unit cylinder with pressure oil even in the early stage of swiveling.

BEST MODE FOR CARRYING OUT THE INVENTION

Figure 2:
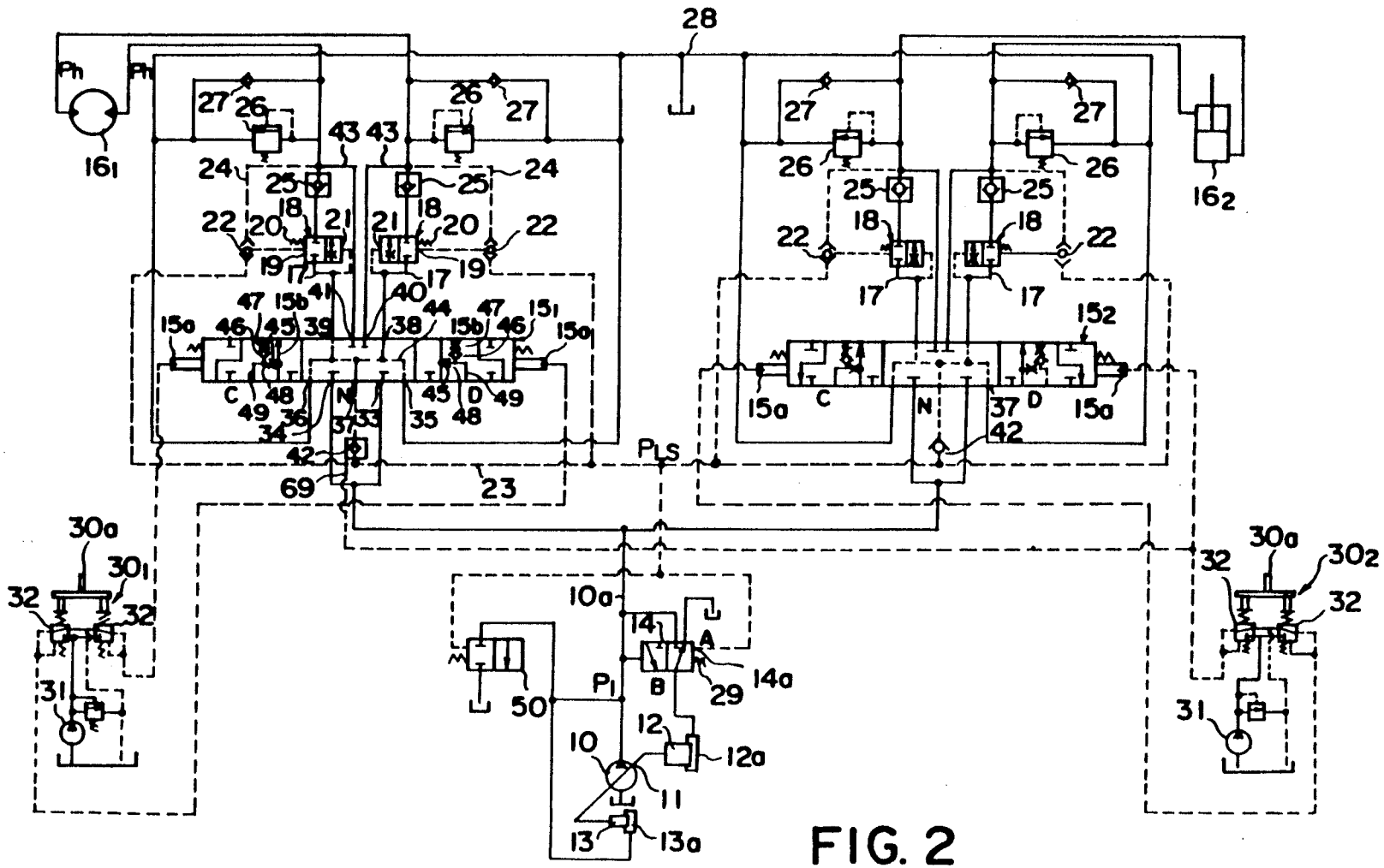
FIG. 2 is a hydraulic circuit diagram showing an embodiment of the present invention.

As shown in FIG. 2, a hydraulic pump 10 is a variable delivery type pump whose capacity, i.e., delivery amount per rotation, is varied by changing the angle of a swash plate 11. A large diameter piston 12 causes the swash plate 11 to incline in a capacity reducing direction, and a small-diameter piston 13 causes it to incline in a capacity increasing direction.

The large diameter piston 12 has a pressure receiving chamber 12*a* which is connected to and disconnected from a delivery conduit 10*a* of the hydraulic pump 10 by a control valve 14, and the small diameter piston 13 has a pressure receiving chamber 13a which is connected to the delivery conduit 10a.

The delivery conduit 10a of the hydraulic pump 10 is provided with first and second operating valves $15_1$ and $15_2$; and the circuits 17 connecting the first and second operating valves $15_1$ and $15_2$ with a swiveling hydraulic motor $16_1$ and a working unit cylinder $16_2$, respectively, are provided with pressure compensating valves 18. The pressure compensating valves 18 are pushed toward the disconnecting position by pressure oil from first pressure receiving sections 19 and springs 20, and toward the connecting position by pressure oil from second pressure receiving sections 21. The second pressure receiving sections 21 are connected to the inlet side of the pressure compensating valves 18 and supplied with an inlet side pressure, and the first pressure receiving sections 19 are connected to a load pressure introducing conduit 23 and retaining pressure introducing conduits 24 and supplied with the maximum load pressure or an actuator retaining pressure.

The retaining pressure introducing conduits 24 are connected to the output side of load check valves 25 in the circuits 17. The load check valves 25 are opened by the output side pressure of the pressure compensating valves 18. The sections between the load check valves 25 and the hydraulic actuators 16 are connected to a draining conduit 28 by way of safety valves 26 and inlet valves 27.

The control valve 14 is pushed toward the connecting position B by the pressure in the delivery conduit 10a, that is, the delivery pressure $P_1$ of the hydraulic pump 10, and is pushed toward the draining position A by the resilient force of a spring 29 and the load pressure $P_{LS}$, acting on a pressure receiving section 14a. When the difference between the delivery pressure $P_1$ and the load pressure $P_{LS}$, $(P_1-P_{LS})=\Delta P_{LS}$, has exceeded the resilient force of the spring 29, the valve 14 is pushed toward the connecting position B and supplies the delivery pressure $P_1$ to the pressure receiving section 12a of the large diameter piston 12, causing the swash plate 11 to incline in the capacity reducing direction. When the pressure difference ΔPLS has become lower than the resilient force of the spring 29, the control valve 14 is pushed toward the draining position A and causes the pressure oil in the pressure receiving section 12a of the large diameter piston 12 to be supplied to the tank side, causing the swash plate 11 to incline in the capacity augmenting direction.

The first and second operating valves $15_1$ and $15_2$ are operated to augment their opening areas in proportion to the amounts of pilot pressure oil supplied from first and second pilot control valves $30_1$ and $30_2$, with the amounts of pilot pressure oil being in proportion to the operational strokes of levers 30a. That is, each of the first and second pilot control valves $30_1$ and $30_2$ is equipped with a plurality of pressure reducing sections 32 for supplying delivery pressure oil from a pilot oil pressure pump 31 in proportion to the operational stroke of the lever 30a, and the output side of each pressure reducing section 32 is connected to a pressure receiving section 15a of the first and second operating valves $15_1$ and $15_2$. When a lever 30a is operated to cause pressure oil to be outputted from one pressure reducing section 32, the first or second operating valve $15_1$ and $15_2$ is switched from a neutral position N to a first or a second pressure oil supplying position C or D, with the switching stroke being in proportion to the amount of pilot pressure oil from the pressure reducing section 32.

Each of the first and second operating valves $15_1$ and $15_2$ is equipped with first and second pump ports 33 and 34, first and second tank ports 35 and 36, a load pressure detecting port 37, first and second actuator ports 38 and 39, and first and second auxiliary ports 40 and 41. The first and second pump ports 33 and 34 are connected to the delivery conduit 10a of the hydraulic pump 10; the first and second tank ports 35 and 36 are connected to the draining conduit 28; and the load pressure detecting port 37 is connected to the load pressure introducing conduit 23 through a check valve 42. The first and second actuator ports 38 and 39 are connected to the inlet side of the pressure compensating valves 18, and the first and second auxiliary ports 40 and 41 are connected to the output side of the load check valves 25 through short-circuit conduits 43 in the circuits 17.

When one of the first and second operating valves $15_1$ and $15_2$ is at its neutral position N (as shown in FIG. 2) the first and second tank ports 35 and 36, the first and second actuator ports 38 and 39 and the load pressure detecting port 37 communicate with each other through a passage 44, with the first and second pump ports 33 and 34 being disconnected from the first and second auxiliary ports 40 and 41.

Figure 4:
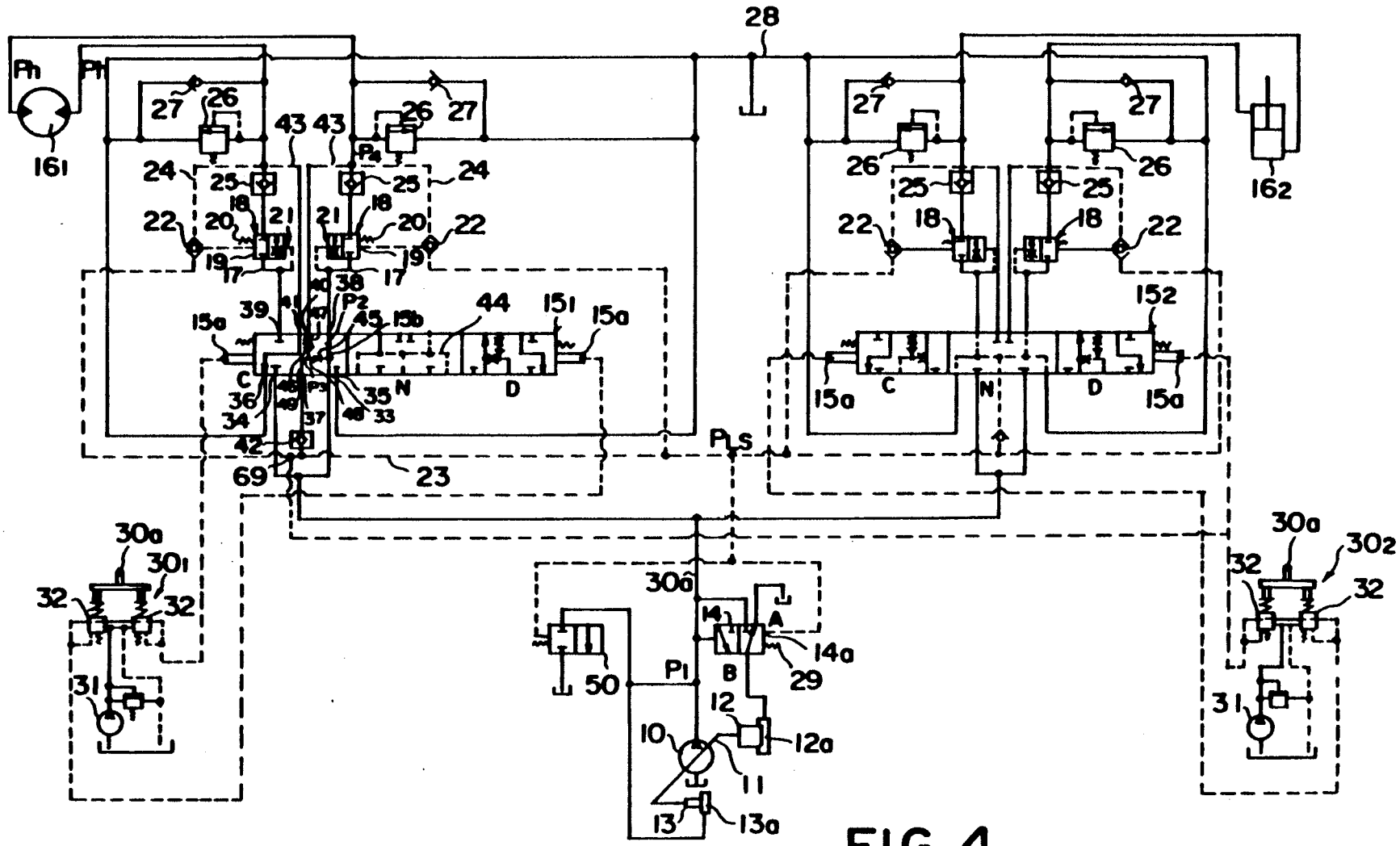
FIG. 4 is a hydraulic circuit diagram illustrating the operation of pressure compensating valves.

When one of the first and second operating valves is at its first pressure oil supplying position C (as shown for value $15_1$ in FIG. 4) the first pump port 33 and the first actuator port 38 communicate with each other through main passage 15b, and the first pump port 33 and the first auxiliary port 40 communicate with each other through passage 48 equipped with first restrictor 45, load check valve 46 and second restrictor 47, with the section between the first restrictor 45 and the load check valve 46 of the passage 48 communicating with the load pressure detecting port 37 through passage 49, and the second auxiliary port 41 communicating with the second tank port 36.

When one of the first and second operating valves is at its second pressure oil supplying position D, the second pump port 34 and the second actuator port 39 communicate with each other through a main passage 15b, and the second pump port 34 and the second auxiliary port 41 communicate with each other, as in the above described case, through a passage 48 equipped with a first restrictor 45, a load check valve 46 and a second restrictor 47, with the section between the first restrictor 45 and the load check valve 46 of the passage 48 communicating with the load pressure detecting port 37 through a passage 49, and the first auxiliary port 40 communicating with the first tank port 35.

Thus, these operating valves 15 are of the closed-center type.

Provided in the delivery conduit 10a of the hydraulic pump 10 is an unloading valve 50, which effects unloading when the pressure difference between the delivery pressure $P_1$ and the load pressure $P_{LS}$, $(P_1-P_{LS})=\Delta P_{LS}$, has exceeded a preset value. The unloading valve is opened when the pressure difference $\Delta P_{LS}$ is large to allow the delivery oil of the hydraulic pump 10 to escape, thereby reducing the peak of the delivery pressure $P_1$. When the operating valves 15 are at the neutral position, the unloading valve causes the delivery oil of the hydraulic pump 10 to be drained to the tank.

Figure 3:
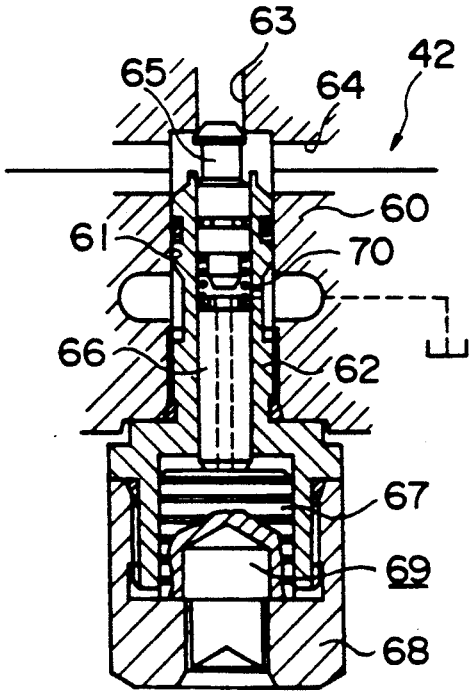
FIG. 3 is a sectional view of a check valve.

The check valve 42 provided on the side of the swiveling hydraulic motor 161 is constructed as shown in FIG. 3.

Fitted into an axial hole 61 of a valve body 60 is a sleeve 62, into which a poppet 65 for connecting and disconnecting first and second ports 63 and 64, a push piston 66 and a piston 67, are successively fitted in the axial direction. The piston 67 is kept from coming off by a plug 68 threadedly connected to the sleeve 62, forming a pressure receiving section 69 with the plug 68. A spring 70 is provided between the push piston 66 and the poppet 65. The push piston 66 abuts the piston 67, and the poppet 65 is biased toward the disconnecting position. Pressure oil from the first port 63 depresses the poppet 65 against the resilient force of the spring 70, thereby allowing the first and second ports 63 and 64 to communicate with each other.

When pressure oil is supplied to the pressure receiving section 69, the piston 67 pushes the push piston 66 to retain the poppet 65 in the disconnecting position, so that the poppet 65 is prevented from moving toward the connecting position even when high pressure oil acts on the first port 63. Thus, as shown in FIG. 2, the first port 63 is connected to the load pressure detecting port 37, with the second port 64 being connected to the load pressure introducing conduit 23. The pressure receiving section 69 is connected to the output side of the second pilot control valve $30_2$.

Next, the operation of this hydraulic circuit will be described.

When the first and second pilot control valves $30_1$ and $30_2$ are operated to bring the first and second operating valves $15_1$ and $15_2$ to the second pressure oil supplying position D so as to supply delivery pressure oil from the hydraulic pump 10 simultaneously to the swiveling hydraulic motor $16_1$ and the working unit cylinder $16_2$, pilot pressure oil from the second pilot control valve $30_2$ is supplied to the pressure receiving section 69 of the check valve 42 provided on the side of the swiveling hydraulic motor 161, causing the check valve 42 to be closed, so that the high load pressure in the early stage of swiveling of the swiveling hydraulic motor 161 is not introduced into the load pressure introducing conduit 23.

As a result, only the load pressure of the working unit cylinder 162, which is at a low pressure level, is introduced into the load pressure introducing conduit 23, and the load pressure of the working unit cylinder 162 acts on the first pressure receiving sections 19 of the pressure compensating valves 18, setting them to a level counterbalancing the load pressure. The openings of the pressure compensating valves 18 attain a level counterbalancing the load pressure of the working unit cylinder $16_2$. The delivery pressure oil of the hydraulic pump 10 is supplied to the working unit cylinder $16_2$, which is at a low pressure level, and to the swiveling hydraulic motor $16_1$, causing the swiveling hydraulic motor $16_1$ to swivel slowly.

When, in the above described condition, the swiveling body starts to rotate at a steady speed by the swiveling hydraulic motor $16_1$, the load pressure of the swiveling hydraulic motor $16_1$ becomes lower than the load pressure of the working unit cylinder $16_2$. However, since, as stated above, the pressure compensating valves 18 have been set to a pressure level counterbalancing the load pressure of the working unit cylinder $16_2$, the valve openings are small, so that the delivery pressure oil from the hydraulic pump 10 is supplied to both the swiveling hydraulic motor $16_1$ and the working unit cylinder $16_2$, thereby causing the swiveling body to swivel at a steady speed, whereby the working machine is enabled to operate.

Next, the operation of the pressure compensating valves will be described.

(1) When the first and second operating valves $15_1$ and $15_2$ are at the neutral position N:

As shown in FIG. 2, the delivery conduit 10a of the hydraulic pump 10 is interrupted by the first and second operating valves $15_1$ and $15_2$, and the delivery pressure oil from the hydraulic pump 10 is blocked. However, since the pressure of the load pressure introducing conduit 23 is zero, the angle of the swash plate 11, i.e., the discharge of the hydraulic pump 10, is reduced, resulting in the delivery pressure $P_1$ attaining a low level counterbalancing the resilient force of the spring 29 of the control valve 14. In this condition, any surplus discharge oil from the hydraulic pump 10 would cause the delivery pressure $P_1$ to be raised. However, the unloading valve 50 is opened, and the discharge oil is allowed to escape to the tank by way of the unloading valve 50.

In this condition, the second pressure receiving sections 21 of the pressure compensating valves 18 communicate with the draining conduit 28 through the first and second actuator ports 38 and 39, the passages 44 and the first and second tank ports 35 and 36. The pressure compensating valves 18 are retained at the disconnecting position by the springs 20, and the retaining pressure Ph of the swiveling hydraulic motor $16_1$ and the working unit cylinder $16_2$ are retained by the pressure compensating valves 18 and, at the same time, by the operating valves 15 through the short-circuit conduits 43, so that the spontaneous drop of the working unit cylinder $16_2$ occurs to a very small degree.

In FIG. 2, the load check valves 25 are provided in order to prevent the retaining pressure from reaching the outlet side of the pressure compensating valves 18, and perform an opening operation so that the outlet side pressure of the compensating valves 18 is kept higher than the retaining pressure.

(2) When the first operating valve $15_1$ is at the first pressure oil supplying position C (see FIG. 4):

① The lever 30a of the first pilot control valve $30_1$ is operated so as to output pressure oil from a pressure reducing section 32. When the pressure oil is supplied to the left pressure receiving section 15a of the first operating valve $15_1$, the first operating valve $15_1$ is switched from the neutral position N to the first pressure oil supplying position C.

This causes discharge oil from the hydraulic pump 10 to be supplied through the first pump port 33, the main passage 15b and the first actuator port 38 to the inlet side of the right pressure compensating valve 18 and, at the same time, to the second pressure receiving section 21 of the right pressure compensating valve 18.

On the other hand, the discharge oil from the hydraulic pump 10 is supplied to the load pressure introducing conduit 23 by way of the passages 48 and 49 and the load pressure detecting port 37 of the first operating valve $15_1$. The pressure of the load pressure introducing conduit 23 is compared with the retaining pressure of the swiveling hydraulic motor $16_1$ by the shuttle valves 22, and acts on the control valve 14 as pilot pressure oil.

② When, in the above described condition, the delivery pressure $P_1$ of the hydraulic pump 10 is lower than the retaining pressure Ph, the retaining pressure Ph is supplied to the first pressure receiving sections 19 of the pressure compensating valves 18 by the shuttle valves 22, so that the pressure compensating valves 18 are retained at the disconnecting position, thereby blocking the discharge oil from the hydraulic pump 10.

A reverse flow of the pressure oil of the swiveling hydraulic motor 161 from the passage 48 of the first operating valve $15_1$ is prevented by the check valve 46.

Even if the shuttle valves 22 are not provided and the pressure of the load pressure introducing conduit 23 is directly supplied to the first pressure receiving sections 19 of the pressure compensating valves 18, no delivery pressure oil flows from the passage 48 to the short-circuit conduits 43 when the discharge pressure $P_1$ of the hydraulic pump 10 is lower than the retaining pressure Ph, so that the pressure of the passage 49 is equal to the pressure of the first actuator port 38. The pressure compensating valves 18 are retained in the disconnecting position by the springs 20 since the pressure of the first pressure receiving sections 19 is equal to the pressure of the second pressure receiving sections 21.

That is, the shuttle valves 22 supply the first pressure receiving sections 19 of the pressure compensating valves 18 with the retaining pressure of the swiveling hydraulic motor $16_1$ when the second operating valve $15_2$ is at the neutral position N, thus using the retaining pressure of the swiveling hydraulic motor $16_1$ as the pressure of the first pressure receiving sections 19.

Thus, even when there are a plurality of operating valves 15, the pressure compensating valves 18 which are not being used can be positively retained at the disconnecting position by utilizing the retaining pressure. Therefore, when the pressure of the load pressure introducing conduit 23 is to be raised by operating one operating valve 15, there is no variation in capacity due to changes in stroke of the other pressure compensating valves 18, so that the pressure rise in the load pressure introducing conduit 23 is speeded up, thereby attaining an improvement in terms of responsiveness.

As a result, the delivery pressure $P_1$ of the hydraulic pump 10 is raised by the above described operation of the control valve 14 and, in consequence, the load pressure $P_{LS}$ is also raised, so that the control valve 14 is pushed toward the draining position A by the load pressure $P_{LS}$, and the pressure receiving chamber 12*a* of the large diameter piston 12 communicates with the drain, causing the swash plate 11 to be swung in the capacity augmenting direction by the small diameter piston 13 so as to cause a further increase in the delivery pressure $P_1$. By repeating this operation, the delivery pressure $P_1$ of the hydraulic pump 10 is gradually increased.

(3) When the delivery pressure $P_1$ of the hydraulic pump 10 has been raised to cause the pressure of the pressure oil flowing through the main passage 15*b*, which connects the first pump port 33 of the first operating valve $15_1$ to the first actuator port 40 thereof, to be raised up to the level of the retaining pressure Ph of the swiveling hydraulic motor $16_1$, pressure oil flows to the swiveling hydraulic motor $16_1$ by way of the load check valve 47 of the passage 48 and the short-circuit conduit 43.

As a result, introduced to the passage 49 connected between the first and second restrictors 45 and 47 is a pressure which is intermediate between the outlet pressure of the main passage 15*b* of the first operating valve $15_1$, that is, the inlet side pressure of the pressure compensating valve 18, and the pressure of the short-circuit conduit 43, that is, the outlet side pressure of the pressure compensating valve 18, the intermediate pressure being supplied as the load pressure PLS from the load pressure introducing conduit 23 to the first pressure receiving section 19 of the pressure compensating valve 18.

This causes the pressure of the first pressure receiving section 19 of the pressure compensating valve 18 to become lower than the pressure of the second pressure receiving section 21 to generate a pressure difference. If this pressure difference exceeds the resilient force of the spring 20, the pressure compensating valve 18 is switched from the disconnecting position to the connecting position, and the delivery pressure oil of the hydraulic pump 10 flows through the first pump port 33, the main passage 15*b*, and the first actuator port 38 of the first operating valve $15_1$, and through the pressure compensating valve 18, and pushes open the load check valve 25 to be supplied to the swiveling hydraulic motor $16_1$. The oil returning from the swiveling hydraulic motor $16_1$ flows by way of the short-circuit conduit 43, the second auxiliary port 41 and the second tank port 36, and flows into the draining conduit 28.

(3) The flow rate of the oil supply to the swiveling hydraulic motor $16_1$:

The pressure difference $\Delta P_{LS}$ between the delivery pressure $P_1$ of the hydraulic pump 10 and the load pressure $P_{LS}$ is determined by:

the pressure loss due to the line resistance of the piping connecting the delivery side of the hydraulic pump 10 to the pump port of the first operating valve $15_1$;

the pressure loss in the main passage 15*b* of the first operating valve $15_1$; and the pressure loss due to the first restrictor 45 of the passage 48.

Here, the first factor, i.e., the pressure loss due to the line resistance, will be ignored since it is very small. Likewise, the line resistance in the other pipings will be ignored. The delivery pressure of the hydraulic pump 10 will be referred to as $P_1$; the outlet pressure of the main passage 15*b* of the first operating valve $15_1$, as $p_2$; the outlet pressure of the first restrictor 45 of the passage 48, as $P_3$; and the outlet pressure of the load check valve 25, as $P_4$. The outlet pressure $P_3$ of the first restrictor 45 of the passage 48 is the load pressure $P_{LS}$.

The opening area of the main passage 15*b* of the first operating valve $15_1$, that is, the opening area of the first pump port 33 and the first actuator port 38, will be referred to as S. If, in this condition, the pressure difference $\Delta P_{LS}$ is smaller than the resilient force of the spring 29 of the control valve 14, the control valve 14 is, as stated above, set to the draining position A, and the angle of the swash plate 11 increases, resulting in an increase in the discharge of the hydraulic pump 10.

As a result, the flow rate in the main passage 15*b* of the first operating valve $15_1$ increases to augment the pressure difference. When the pressure difference $\Delta P_{LS}$ has exceeded the resilient force of the spring 29, the control valve 14 is set to the connecting position B, resulting in a reduction in the discharge of the hydraulic pump 10, as stated above. That is, the control valve 14 exerts a balancing action in such a way that the following relationship holds true: (the pressure difference $\Delta$PLS)$\times$(the pressure receiving area of the pressure receiving section 14*a*)=(the resilient force of the spring 29), with the discharge of the hydraulic pump 10 being controlled in such a way that the pressure difference $\Delta P_{LS}$ attains a value counterbalancing the resilient force of the spring 29.

In the above described condition, the flow rate Q in the swiveling hydraulic motor 161 can be expressed by the following equation:

$$Q = CS\sqrt{(\Delta PLS)} = CS\sqrt{(P1 - PLS)}$$
$$= CS\sqrt{\{(P1 - P2) + (P2 - P3)\}}$$

where C is constant, and S is the opening area of the main passage 15*b* of the operating valve 15.

Thus, the flow rate Q in the swiveling hydraulic motor $\mathbf{16}_1$ is not expressed as:

$$Q = CS\sqrt{(P1 - P2)}$$

but as:

$$Q = CS\sqrt{\{(P1 - P2) + (P2 - P3)\}}$$

Thus, it is not perfectly proportional to the opening area S of the main passage 15*b* of the operating valve 15 but involves an error corresponding to the term: (P2−P3). However, by augmenting the opening area S of the main passage 15*b* of the first operating valve $\mathbf{15}_1$ by an amount corresponding to the error, the requisite flow rate can be ensured when supplying pressure oil to the swiveling hydraulic motor $\mathbf{16}_1$.

By way of example, the values of the pressures may be as follows:

Assuming that the retaining pressure Ph of the swiveling hydraulic motor 161 is 150 kg/cm$^2$ and the set spring force of the control valve 14 is 20 kg/cm$^2$, $P_1$=173 kg/cm$^2$, $P_2$=156 kg/cm$^2$, $P_3$=153 kg/cm$^2$, and $P_4$ 150 kg/cm$^2$=the retaining pressure Ph.

It is the same with the case where pressure oil is supplied only to the working unit cylinder $\mathbf{16}_2$.

Figure 1:
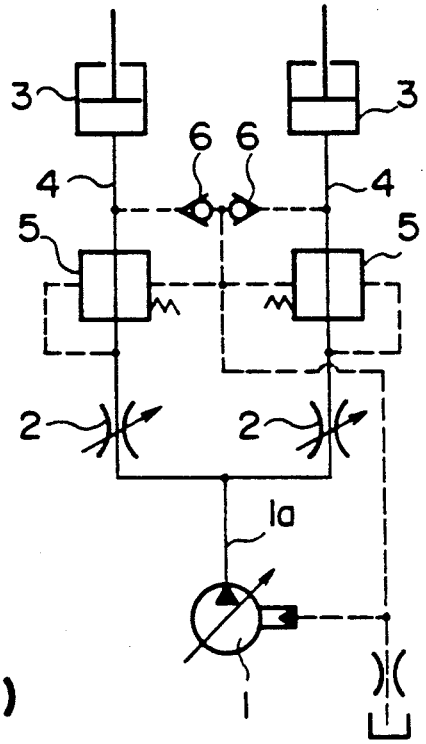
FIG. 1 (PRIOR ART)
FIG. 1 is a hydraulic circuit diagram showing a conventional example.

The load pressure detecting circuits are not restricted to those described above. The detecting circuits shown in FIG. 1 will of course serve the purpose as well.

As described in detail above, when the first and second operating valves $\mathbf{15}_1$ and $\mathbf{15}_2$ are simultaneously operated, the check valve 42 for detecting the load pressure of the swiveling hydraulic motor $\mathbf{16}_1$ does not operate, and the pressure compensating valves are set with the load pressure of the working unit cylinder $\mathbf{16}_2$, so that it is possible to sufficiently supply pressure oil to the working unit cylinder $\mathbf{16}_2$ in the early stage of swiveling when simultaneously operating the swiveling body and the working unit, thereby speeding up the operation of the working unit.

INDUSTRIAL APPLICABILITY

The present invention provides, in a swiveling working machine, such as a hydraulic excavator, which has a working unit attached to a swiveling body, a useful hydraulic circuit which involves no operational delay of the working unit when the swiveling body and the working unit are simultaneously operated.

What is claimed is:

1. A hydraulic circuit for a swivel working machine of the type in which a delivery conduit of a hydraulic pump is connected to a swiveling hydraulic motor and a working unit cylinder by way of first and second operating valves, respectively, and in which pressure compensating valves are provided between the first operating valve and the swiveling hydraulic motor and between the second operating valve and the working unit cylinder, the respective load pressures of the swiveling hydraulic motor and the working unit cylinder being introduced into a load pressure introducing conduit by way of check valves to set the pressure compensating valves by the load pressure of the load pressure introducing conduit, and with means for applying a closing pressure to the check valve for detecting the load pressure of the swiveling hydraulic motor, to close the check valve for detecting the load pressure of the swiveling hydraulic motor when the working unit cylinder is operated by the second operating valve.

2. A hydraulic circuit for a swivel working machine according to claim 1, wherein the check valve for detecting the load pressure of said swiveling hydraulic motor includes a sleeve fitted into an axial hole of a valve body, into which sleeve are axially fitted: a poppet which connects and disconnects a first port, that is connected to a load pressure detecting port of the first operating valve, to and from a second port that is connected to a load pressure introducing conduit of the first operating valve; and a piston, which is kept from coming off by a plug threadedly connected to said sleeve, forming a pressure receiving section with this plug, and wherein when pressure oil from a pilot control valve of said working unit cylinder is supplied to said pressure receiving section, said piston retains said poppet in a disconnecting position, so that said poppet is prevented from moving to a connecting position even when high pressure oil acts on said first port.

3. A hydraulic circuit for a swivel working machine according to claim 2, wherein a push piston is provided between said poppet and said piston, with a spring being provided between said push piston and said poppet in such a way as to cause said push piston to abut said piston, said poppet being also biased toward the disconnecting position for the first and second ports.

4. A swivel working machine comprising a swiveling body, a swiveling hydraulic motor for swiveling said swiveling body, a working unit, a hydraulic cylinder for operating said working unit, and a hydraulic circuit for supplying hydraulic fluid to said swiveling hydraulic motor and to said hydraulic cylinder, said swiveling hydraulic motor having first and second ports, said hydraulic cylinder having first and second ports, said hydraulic circuit comprising:

a hydraulic pump having an outlet;

a first operating valve, said first operating valve having at least one inlet port and first and second output ports, said first operating valve having first and second operating positions and a neutral position;

a second operating valve, said second operating valve having at least one inlet port and first and second output ports, said second operating valve having first and second operating positions and a neutral position;

a first pressure compensating valve, a second pressure compensating valve, a third pressure compensating valve, a fourth pressure compensating valve, each of these pressure compensating valves having at least a first pressure receiving section;

a first conduit connecting said outlet of said hydraulic pump to said at least one inlet port of said first operating valve;

a second conduit connecting said output of said hydraulic pump to said at least one inlet port of said second operating valve;

a third conduit connecting said first output port of said first operating valve through said first pressure compensating valve to said first port of said swiveling hydraulic motor;

a fourth conduit connecting said second output port of said first operating valve through said second pressure compensating valve to said second port of said swiveling hydraulic motor;

a fifth conduit connecting said first output port of said second operating valve through said third pressure compensating valve to said first port of said hydraulic cylinder;

a sixth conduit connecting said second output port of said second operating valve through said fourth pressure compensating valve to said second port of said hydraulic cylinder;

first and second load pressure introduction check valves, each of said first and second load pressure introduction check valves having an inlet and an outlet;

a seventh conduit connecting said first port of said swiveling hydraulic motor through said first operating valve to said inlet of said first load pressure introduction check valve when said first operating valve is in its first operating position;

an eighth conduit connecting said second port of said swiveling hydraulic motor through said first operating valve to said inlet of said first load pressure introduction check valve when said first operating valve is in its second operating position;

a ninth conduit connecting said first port of said hydraulic cylinder through said second operating valve to said inlet of said second load pressure introduction check valve when said second operating valve is in its first operating position;

a tenth conduit connecting said second port of said hydraulic cylinder through said second operating valve to said inlet of said second load pressure introduction check valve when said second operating valve is in its second operating position;

a load pressure introduction conduit connecting the outlet of said first load pressure introduction check valve and the outlet of said second load pressure introduction check valve to the first pressure receiving section of each of said first, second, third, and fourth pressure compensating valves to set these pressure compensating valves;

a first controller for actuating said first operating valve from one of its positions to another of its positions;

a second controller for actuating said second operating valve from one of its positions to another of its positions; and means for applying a closing pressure to said first load pressure introduction check valve to close said first load pressure introduction check valve when said second controller actuates said second operating valve to one of its operating positions.

5. A swivel working machine in accordance with claim 4, further comprising a pressure control valve connected to said outlet of said hydraulic pump to control the pressure in said first and second conduits, said pressure control valve having a pressure receiving section which is connected to said load pressure introduction conduit.

6. A swivel working machine in accordance with claim 4, wherein each of said first pressure compensating valve, said second pressure compensating valve, said third pressure compensating valve, and said fourth pressure compensating valve has a second pressure receiving section, with each second pressure receiving section being connected to the input of the respective pressure compensating valve.

7. A swivel working machine in accordance with claim 4, wherein said third conduit contains a first load pressure check valve positioned between said first pressure compensating valve and said first port of said swiveling hydraulic motor for retaining the pressure at said first port of said swiveling hydraulic motor;

said fourth conduit contains a second load pressure check valve positioned between said second pressure compensating valve and said second port of said swiveling hydraulic motor for retaining the pressure at said second port of said swiveling hydraulic motor;

said fifth conduit contains a third load pressure check valve positioned between said third pressure compensating valve and said first port of said hydraulic cylinder for retaining the pressure at said first port of said hydraulic cylinder; and said sixth conduit contains a fourth load pressure check valve positioned between said fourth pressure compensating valve and said second port of said hydraulic cylinder for retaining the pressure at said second port of said hydraulic cylinder.

8. A swivel working machine in accordance with claim 7, wherein said load pressure introduction conduit is connected to the first pressure receiving section of each of said first, second, third, and fourth pressure compensating valves through a respective one of first, second, third, and fourth shuttle valves, each shuttle valve having first and second inputs and an output with the first input being connected to said load pressure introduction conduit and the output being connected to the first pressure receiving section of the respective pressure compensating valve, the second input of the first shuttle valve being connected to said third conduit between said first load pressure check valve and said first port of said swiveling hydraulic motor, the second input of the second shuttle valve being connected to said fourth conduit between said second load pressure check valve and said second port of said swiveling hydraulic motor, the second input of the third shuttle valve being connected to said fifth conduit between said third load pressure check valve and said first port of said hydraulic cylinder, the second input of the fourth shuttle valve being connected to said sixth conduit between said fourth load pressure check valve and said second port of said hydraulic cylinder.

9. A swivel working machine in accordance with claim 4, further comprising a first safety valve connected between said first port of said swiveling hydraulic motor and a drain, a second safety valve connected between said second port of said swiveling hydraulic motor and said drain, a third safety valve connected between said first port of said hydraulic cylinder and said drain, and a fourth safety valve connected between said second port of said hydraulic cylinder and said drain.

10. A swivel working machine in accordance with claim 4, wherein said seventh conduit connects said first port of said swiveling hydraulic motor to a drain via said first operating valve when said first operating valve is in its second operating position and connects said first port of said swiveling hydraulic motor to an input port of said first operating valve via a restriction when said first operating valve is in its first operating position, wherein said eighth conduit connects said second port of said swiveling hydraulic motor to a drain via said first operating valve when said first operating valve is in its first operating position and connects said second port of said swiveling hydraulic motor to an input port of said first operating valve via a restriction when said first operating valve is in its second operating position.

11. A swivel working machine in accordance with claim 10, wherein said ninth conduit connects said first port of said hydraulic cylinder to a drain via said second operating valve when said second operating valve is in its second operating position and connects said first port of said hydraulic cylinder to an input port of said second operating valve via a restriction when said second operating valve is in its first operating position, and wherein said tenth conduit connects said second port of said hydraulic cylinder to a drain via said second operating valve when said second operating valve is in its first operating position and connects said second port of said hydraulic cylinder to an input port of said second operating valve via a restriction when said second operating valve is in its second operating position.

12. A swivel working machine in accordance with claim 4, wherein said load pressure introduction check valve for detecting the load pressure of said swiveling hydraulic motor includes a valve body having a first port and a second port and a hole, a poppet and a main piston positioned in said hole, said main piston having a pressure receiving section, said poppet having a first position in which it connects the first and second ports of the valve body and a second position in which it disconnects the first and second ports of the valve body, the first port of the valve body being connected to a load pressure detecting port of the first operating valve, the second port of the valve body being connected to said load pressure introduction conduit, whereby pressure in the first port of said valve body tends to move said poppet to its first position; and wherein said means for applying a closing pressure to said first load pressure introduction check valve to close said first load pressure introduction check valve when said second controller actuates said second operating valve to one of its operating positions comprises means for applying a pressure to the pressure receiving section of said main piston to move said poppet to its second position.

13. A swivel working machine in accordance with claim 12, wherein said means for applying a closing pressure to said first load pressure introduction check valve to close said first load pressure introduction check valve when said second controller actuates said second operating valve to one of its operating positions comprises a pilot control valve associated with said hydraulic cylinder.

14. A swivel working machine in accordance with claim 12, wherein said load pressure introduction check valve for detecting the load pressure of said swiveling hydraulic motor further comprises a push piston positioned in said hole between said poppet and said main piston, and a spring positioned between said push piston and said poppet so as to cause said push piston to abut said main piston.

15. A swivel working machine in accordance with claim 4, wherein said means for applying a closing pressure to said first load pressure introduction check valve to close said first load pressure introduction check valve when said second controller actuates said second operating valve to one of its operating positions comprises a pilot control valve associated with said hydraulic cylinder.

16. A swivel working machine in accordance with claim 15, further comprising a pressure control valve connected to said outlet of said hydraulic pump to control the pressure in said first and second conduits, said pressure control valve having a pressure receiving section which is connected to said load pressure introduction conduit.

17. A swivel working machine in accordance with claim 16, wherein each of said first pressure compensating valve, said second pressure compensating valve, said third pressure compensating valve, and said fourth pressure compensating valve has a second pressure receiving section, with each second pressure receiving section being connected to the input of the respective pressure compensating valve.

18. A swivel working machine in accordance with claim 17, wherein said third conduit contains a first load pressure check valve positioned between said first pressure compensating valve and said first port of said swiveling hydraulic motor for retaining the pressure at said first port of said swiveling hydraulic motor;

said fourth conduit contains a second load pressure check valve positioned between said second pressure compensating valve and said second port of said swiveling hydraulic motor for retaining the pressure at said second port of said swiveling hydraulic motor;

said fifth conduit contains a third load pressure check valve positioned between said third pressure compensating valve and said first port of said hydraulic cylinder for retaining the pressure at said first port of said hydraulic cylinder; and said sixth conduit contains a fourth load pressure check valve positioned between said fourth pressure compensating valve and said second port of said hydraulic cylinder for retaining the pressure at said second port of said hydraulic cylinder.

19. A swivel working machine in accordance with claim 18, wherein said load pressure introduction conduit is connected to the first pressure receiving section of each of said first, second, third, and fourth pressure compensating valves through a respective one of first, second, third, and fourth shuttle valves, each shuttle valve having first and second inputs and an output with the first input being connected to said load pressure introduction conduit and the output being connected to the first pressure receiving section of the respective pressure compensating valve, the second input of the first shuttle valve being connected to said third conduit between said first load pressure check valve and said first port of said swiveling hydraulic motor, the second input of the second shuttle valve being connected to said fourth conduit between said second load pressure check valve and said second port of said swiveling hydraulic motor, the second input of the third shuttle valve being connected to said fifth conduit between said third load pressure check valve and said first port of said hydraulic cylinder, the second input of the fourth shuttle valve being connected to said sixth conduit between said fourth load pressure check valve and said second port of said hydraulic cylinder.

20. A swivel working machine in accordance with claim 19, wherein said seventh conduit connects said first port of said swiveling hydraulic motor to a drain via said first operating valve when said first operating valve is in its second operating position and connects said first port of said swiveling hydraulic motor to an input port of said first operating valve via a restriction when said first operating valve is in its first operating position, wherein said eighth conduit connects said second port of said swiveling hydraulic motor to a drain via said first operating valve when said first operating valve is in its first operating position and connects said second port of said swiveling hydraulic motor to an input port of said first operating valve via a restriction when said first operating valve is in its second operating position.

21. A swivel working machine in accordance with claim 20, wherein said ninth conduit connects said first port of said hydraulic cylinder to a drain via said second operating valve when said second operating valve is in its second operating position and connects said first port of said hydraulic cylinder to an input port of said second operating valve via a restriction when said second operating valve is in its first operating position, and wherein said tenth conduit connects said second port of said hydraulic cylinder to a drain via said second operating valve when said second operating valve is in its first operating position and connects said second port of said hydraulic cylinder to an input port of said second operating valve via a restriction when said second operating valve is in its second operating position.

22. A swivel working machine in accordance with claim 21, wherein said load pressure introduction check valve for detecting the load pressure of said swiveling hydraulic motor includes a valve body having a first port and a second port and a hole, a poppet and a main piston positioned in said hole, said main piston having a pressure receiving section, said poppet having a first position in which it connects the first and second ports of the valve body and a second position in which it disconnects the first and second ports of the valve body, the first port of the valve body being connected to a load pressure detecting port of the first operating valve, the second port of the valve body being connected to said load pressure introduction conduit, whereby pressure in the first port of said valve body tends to move said poppet to its first position; and wherein said means for applying a closing pressure to said first load pressure introduction check valve to close said first load pressure introduction check valve when said second controller actuates said second operating valve to one of its operating positions comprises means for applying a pressure to the pressure receiving section of said main piston to move said poppet to its second position.

23. A swivel working machine in accordance with claim 22, wherein said load pressure introduction check valve for detecting the load pressure of said swiveling hydraulic motor further comprises a push piston positioned in said hole between said poppet and said main piston, and a spring positioned between said push piston and said poppet so as to cause said push piston to abut said main piston.

24. A swivel working machine in accordance with claim 23, further comprising a first safety valve connected between said first port of said swiveling hydraulic motor and a drain, a second safety valve connected between said second port of said swiveling hydraulic motor and said drain, a third safety valve connected between said first port of said hydraulic cylinder and said drain, and a fourth safety valve connected between said second port of said hydraulic cylinder and said drain.

* * * * *